US008944921B2

(12) United States Patent
Knapp et al.

(10) Patent No.: US 8,944,921 B2
(45) Date of Patent: Feb. 3, 2015

(54) PERFORMANCE BASED SPORTS SCORING SYSTEM

(71) Applicant: Big Play Scoring, LLC, Houston, TX (US)

(72) Inventors: Michael Knapp, Houston, TX (US); Jack Stanfield, Houston, TX (US)

(73) Assignee: Big Play Scoring, LLC, Houston, TX (US)

( * ) Notice: Subject to any disclaimer, the term of this patent is extended or adjusted under 35 U.S.C. 154(b) by 79 days.

(21) Appl. No.: 13/785,748

(22) Filed: Mar. 5, 2013

(65) Prior Publication Data

US 2014/0081437 A1 Mar. 20, 2014

Related U.S. Application Data

(60) Provisional application No. 61/606,536, filed on Mar. 5, 2012, provisional application No. 61/684,245, filed on Aug. 17, 2012.

(51) Int. Cl.
*A63B 71/06* (2006.01)

(52) U.S. Cl.
CPC ..... *A63B 71/06* (2013.01)
USPC ..... 463/42; 700/92

(58) Field of Classification Search
CPC ..... A63F 13/00; A63F 9/24; A63B 71/06
USPC ..... 463/4, 42
See application file for complete search history.

(56) References Cited

U.S. PATENT DOCUMENTS

| | | | | |
|---|---|---|---|---|
| 6,371,855 | B1 | 4/2002 | Gavriloff | |
| 6,656,042 | B2 | 12/2003 | Reiss | |
| 7,614,944 | B1 | 11/2009 | Hughes | |
| 2006/0252476 | A1 | 11/2006 | Bahou | |
| 2008/0280685 | A1 * | 11/2008 | Hansen et al. | 463/42 |
| 2012/0009984 | A1 * | 1/2012 | Amaitis et al. | 463/4 |
| 2012/0149473 | A1 * | 6/2012 | Moore et al. | 463/42 |
| 2012/0202599 | A1 * | 8/2012 | Cohen | 463/42 |
| 2012/0270615 | A1 * | 10/2012 | Jones et al. | 463/4 |

FOREIGN PATENT DOCUMENTS

| | | | |
|---|---|---|---|
| WO | 2010/085429 | A1 | 7/2010 |
| WO | 2010-085429 | A1 | 7/2010 |

* cited by examiner

*Primary Examiner* — Paul A. D'Agostino
*Assistant Examiner* — Ankit Doshi
(74) *Attorney, Agent, or Firm* — Hulsey Calhoun, PC; William N. Hulsey

(57) ABSTRACT

An automated, replicable, process-based original concept that provides a self-validating, defined quantification of the relevance of a series of plays or physical and/or mental efforts of competing, simultaneously occurring diametrically opposed strategy and tactics of two or more different teams or individuals engaged in a contest or exhibition of athleticism and skill resulting in a traditionally defined winner and loser, or ranking of participants based on their performance relative to one another.

19 Claims, 1 Drawing Sheet

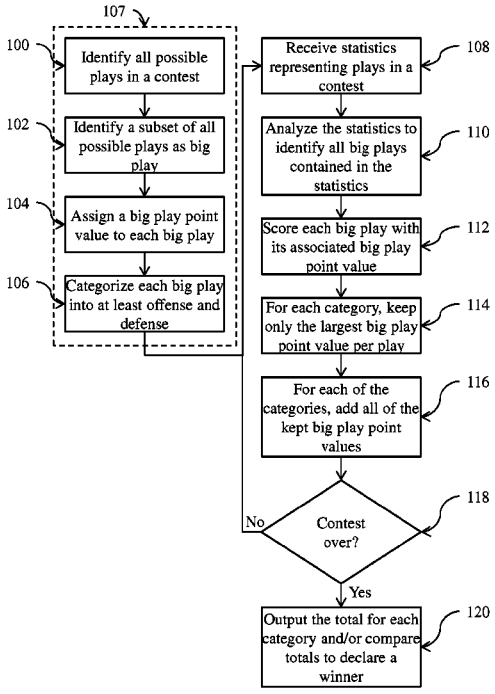

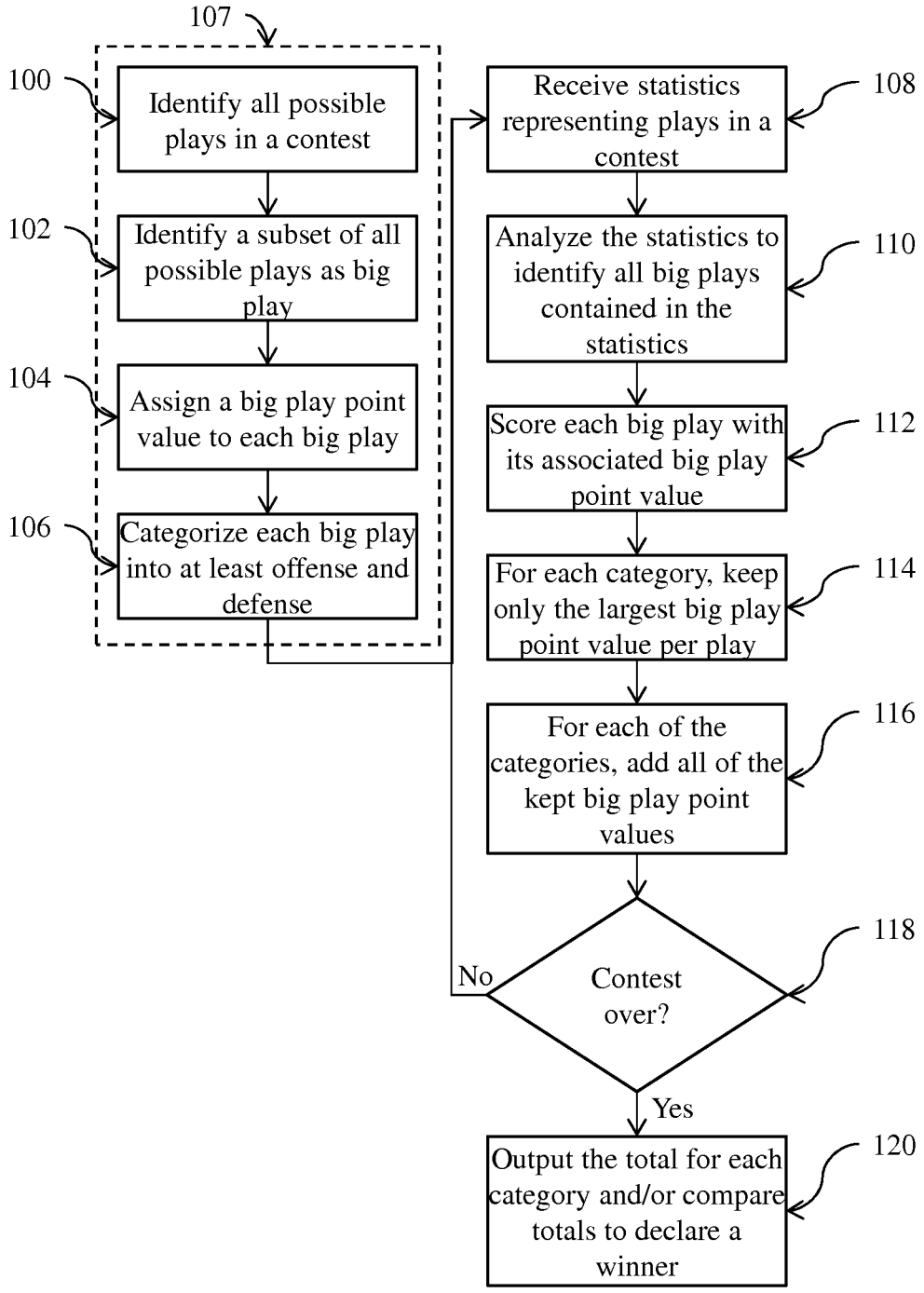
107
100
Identify all possible plays in a contest
102
Identify a subset of all possible plays as big play
104
Assign a big play point value to each big play
106
Categorize each big play into at least offense and defense
Receive statistics representing plays in a contest
108
Analyze the statistics to identify all big plays contained in the statistics
110
Score each big play with its associated big play point value
112
For each category, keep only the largest big play point value per play
114
For each of the categories, add all of the kept big play point values
116
Contest over?
118
No
Yes
Output the total for each category and/or compare totals to declare a winner
120

PERFORMANCE BASED SPORTS SCORING SYSTEM

TECHNICAL FIELD

This disclosure relates in general to a scoring system and more particularly to a scoring system for measuring performance data of a sport, athletic event, performance event, or activity.

BACKGROUND

Fantasy sport leagues are becoming widespread through the United States and the world. Fantasy sports allow sports fans to take an active role in professional or collegiate sports where the sports fans act as team owners to build a team that competes against other fantasy sport teams. The fantasy sport team owner creates their own roster of players by drafting players from actual professional or collegiate sports teams and use those players' real-life performance in professional or collegiate games to convert statistical performance into points. However, current fantasy sport leagues are organized and scored in such a manner that in order to be successful, the participant must be a real sports enthusiast with time to follow entire leagues of players and teams, rendering the fantasy sports leagues less accessible to moderate sports fans.

Fantasy sport leagues may be based upon a number of different sports, including, but not limited to: football, basketball, baseball, hockey, soccer, cricket, golf, auto racing, mixed martial arts, professional wrestling, boxing, billiards, bowling, chess, etc. The fantasy sport leagues can even further be based upon the different leagues or associations within a sport. For example, a fantasy football league may be based upon the National Football League or it may be based upon NCAA Collegiate football. Similarly, a fantasy basketball league may be based only on the National Basketball Association's (NBA) Eastern Conference or Western Conference. Some fantasy sport leagues may be even further limiting, and restrict fantasy sport leagues to only certain teams or even certain categories of players.

There currently exists many different scoring systems and corresponding fantasy points. Generally, fantasy points are based upon actual player or team performance in a particular game or event. Probably the most common scoring system converts statistical performance of real-life players or teams into fantasy points that are compiled and totaled according to a selected roster of the fantasy team. More complex variants may include computer modeling of actual games, but based upon selected fantasy roster, based on statistical input generated by real-life players or teams. However, different sports fantasy leagues often include different scoring systems that can make certain players or teams more or less valuable in one fantasy sports league as opposed to another different fantasy sports league.

One exemplary scoring system, head-to-head league scoring, is based on fantasy teams competing weekly to see which teams can compile the best statistics across a number of different scoring categories, with "wins" awarded based on the cumulative total for each scoring category used in the league for the week. Using basketball as an example, the league may be set up to use points scored, rebounds, assists, blocked shots, field goal percentage (FG %), free throw percentage (FT %) and 3 pointers made as scoring categories. If in a given week, a team has more assists than its opponent's, the team would be credited with a "win" for that scoring category. However, if the opponent's team ended the week with more blocked shots, the team be charged with a "loss" for that scoring category. If the two teams end up tied in a given category, each will receive credit for a "tie". This weekly win-loss-tie total will be added to a cumulative season record, which can be used to determine final standings or playoff seeding. These standings will be based on your team's overall winning percentage, which is calculated by taking your win total and adding one-half of your tie total and dividing the sum by the total number of games your team has played. Unfortunately, this requires the fantasy sport league participant to draft and form teams based on their ability to produce in various scoring categories. This requires a deep knowledge of individual players and team; consequently, most sports fans merely root for their hometown teams, without the underlying knowledge of sports statistics.

Another exemplary scoring system, the fantasy point league scoring, is based on points being awarded on how well players perform in each of predetermined statistical scoring categories. All real-life statistics have associated point values, and each player's points are summed to produce daily totals. Using football as an example, the league may be set up to give a certain number of fantasy points for touchdowns scored, rushing yards, passing yards, receiving yards, field goals, etc. If in the league, a touchdown is worth six points, 10 rushing yards worth one point, and 10 receiving yards worth one point, a player with two touchdowns, 100 yards rushing, and 30 yards receiving would score 12 points for two touchdowns, 10 points for 100 rushing yards and 3 points for 30 receiving yards, which would total 25 fantasy points for that player. Fantasy points are only awarded to starting players on your fantasy team's roster. This scoring method may be used to determine a weekly, head-to head winner as is frequently used in fantasy football leagues. Alternatively, it may be used to keep a running total of fantasy points throughout the season as is commonly used in fantasy basketball, football and baseball leagues. In these leagues, the team with the highest total of fantasy points at the end of the year is the league champion. This scoring system suffers from the same drawbacks as head-to-head league scoring, namely, that fantasy sports league participants require extensive knowledge of individual players' statistics and is further compounded with the fact that only players on the roster generate points. Fantasy sports league participants often need to change up their rosters in response to real-life player injuries or underperformance.

Many of these scoring drawbacks are evident in the fantasy sport team formation process, often referred to as the draft. The goal of the draft is to choose the players that the fantasy sport league participant believes will generate the most fantasy points. These participants choose real-life players based upon published statistics for that player and draft the player onto their fantasy team based upon availability and whatever other information they have gathered. Preparation for this draft process can be an incredibly time consuming effort, especially where the fantasy sport league's scoring system is complex. Additionally, the choice of players and their position within the roster can be a tedious process.

Another scoring drawback is the inability to weight particular plays, accomplishments, or successes. Each "win" or each accomplishment is awarded the same points (e.g. one point for each 20 yards of rushing). Existing fantasy sports scoring systems have attempted to address this by adjusting the accomplishment instead of the scoring itself (e.g. one point for 30 yards of rushing as opposed to one point for 20 yards of rushing). Furthermore, existing fantasy sports scoring are based on the total statistics for a player (e.g. the entire games total in a certain statistical area).

Although various scoring systems for fantasy sport leagues are known in the art, all, all of them suffer from one or more disadvantages. Therefore a need has arisen for a more automated and replicable scoring system which corrects the problems identified above.

SUMMARY

The following disclosure presents concepts for improving scoring systems of fantasy sport leagues. The disclosed subject matter significantly improves upon prior scoring systems aimed at measuring real-life player or team performance. It is an object of the present disclosure to provide self-validation, defined quantification of the relevance of physical and/or mental efforts of competitors engaging in a contest of athleticism or skill.

The present disclosure teaches an automated, replicable scoring process, wherein there is a defined quantification of the relevance of a series of plays or physical and/or mental efforts of two or more different teams or individuals, resulting in ranking of participants based on their performance relative to another.

One aspect of the disclosed subject matter is pre-determined point levels for achievements within a game or competitive event.

Another aspect of the disclosed subject matter is the ability to simplify fantasy league scoring for participants.

Yet another aspect of the disclosed subject matter is the ability for multiple fantasy sport league participants to score on the same play.

Another aspect of the disclosed subject matter is the lack of penalties within the scoring system.

Another aspect of the disclosed subject matter is a hybrid team challenge wherein multiple participants may compete in their knowledge of sports in various scoring components.

Yet another aspect of the disclosed subject matter is random, auto-generated selection of scoring components.

Another aspect of the disclosed subject matter is the opportunity to foster continued engagement with the system by including additional scoring opportunities.

Yet another aspect of the disclosed subject matter is recognition of achievements by fantasy sport league participants.

These and other aspects of the disclosed subject matter, as well as additional novel features, will be apparent from the description provided herein. The intent of this summary is not to be a comprehensive description of the claimed subject matter, but rather to provide a short overview of some of the subject matter's functionality. Other systems, methods, features and advantages here provided will become apparent to one with skill in the art upon examination of the following FIGUREs and detailed description. It is intended that all such additional systems, methods, features and advantages that are included within this description, be within the scope of the appended claims and/or those claims filed later.

BRIEF DESCRIPTIONS OF THE DRAWINGS

The novel features believed characteristic of the presently disclosed subject matter are set forth in the claims appended hereto or will be set forth in any claims that are filed later. The presently disclosed subject matter itself, however, as well as a preferred mode of use, further objectives, and advantages thereof, will best be understood by reference to the following detailed description of an illustrative embodiment when read in conjunction with the accompanying drawings, wherein:

FIG. 1 depicts a generalized flow chart of the setup and application of the method according to the disclosed subject matter.

DETAILED DESCRIPTION OF THE SPECIFIC EMBODIMENTS

Although described with particular reference to football, those with skill in the arts will recognize that the disclosed embodiments have relevance to a wide variety of sports categories in addition to those specific examples described below.

All references, including publications, patent applications, and patents, cited herein are hereby incorporated by reference to the same extent as if each reference were individually and specifically indicated to be incorporated by reference and were set forth in its entirety herein.

The present disclosure enables an alternative analysis method and scoring system for sports games, particularly football as described herein.

Football enthusiasts have often wondered why an exemplary 14-10 game can be infinitely more compelling than a second exemplary 27-24 game. It is counter-intuitive that the game with fewer points scored can be immeasurably more entertaining to watch than the contest with more points. However, if one takes a step back and takes an objective view of the sport, football is essentially an offensive team of eleven players that have four chances, or downs, to advance the ball ten yards from the spot they took possession of it. At the same time, the opposing team's set of eleven defensive players are trying to thwart that ten yard advance. The majority of the game is comprised of small back and forth gains and losses. A few yards may be gained by throwing or running, and a few yards lost by being tackled. However, very little of this has a direct impact on the points that end up on the scoreboard.

For example, Quarterback A is throwing well and has thrown to advance the ball up the field for a total of 70 yards. However, as the team is trying to enter the end zone to score, multiple mistakes happen. Perhaps the running back runs the wrong route and misses his catch. Perhaps Quarterback A throws errantly too high for the receiver to catch. On the fourth down, the offense is forced to punt the ball downfield. There was a tremendous amount of effort expended, and in traditional fantasy football scoring systems Quarterback A will look great for having just completed 70 passing yards. However, none of that is reflected on the scoreboard and has no bearing on the ultimate outcome of the game. This overall back and forth, give and take process is even more evident in the game of basketball where if distilled down enough, players are just running up and down the court attempting to put the ball in the basket for two points.

In prior standard fantasy football scoring systems, the goal was to define statistical and point-value relationships to ensure that each fantasy position and player was relatively equal in weight and value with regards to the system. These are some relatively well established offensive scoring rules in fantasy football that are in use today:

Touchdowns: 6 points—In the standard fantasy football scoring system, touchdowns are universally worth 6 points, just like in real life. It does not matter if the touchdown was scored by a quarterback, receiver, running back, defensive safety, or even a kicker; all touchdowns are 6 points.

Rushing: 1 point per 10 yards—Each rushing yard in fantasy football will net the fantasy team 0.1 point if the league awards fractional points, or 1 point for every 10 yards.

Receiving: 1 point per 10 yards—Each receiving yard in fantasy football will net the fantasy team 0.1 point, or 1 point for every 10 yards.

Passing: 1 point per 25 yards—Because passing yards are much easier to come by than rushing or receiving yards, they are not worth quite as much. Passing yards in the standard scoring system are worth 0.04 point, or 1 point for every 25 yards.

Now, imagine this scenario from an exemplary football game where the following statistics were compiled for three different fantasy players. Quarterback: 375 yards passing; Running Back: 40 yards rushing, 2 touchdowns; Wide Receiver: 100 yards receiving, 1 touchdown. Each of these would have resulted in the same output: 16 fantasy football points. However, it is difficult to gauge whether these values actually helped the team gain an advantage over their competitor or whether the values are standard within the back and forth nature of the sport.

The main driver that differentiates results of games and contests are the "big plays", something out of the ordinary from the mundane regular few yard gains and losses from running and passing plays. If one watches a football game and keeps tally of the "big plays" of both teams and keeps a running total of the tally of big play points vs. points on the scoreboard, some very interesting conclusions emerge. At the conclusion of each score, period, or contest, the team with the most big plays is more likely than not to prevail on the scoreboard as well. Interestingly, big play totals will often tell a more accurate story of how close or lopsided, entertaining or boring the game really was.

The present disclosure teaches an original concept based on the awarding of points for big plays during a game relative and commensurate to both their impact on the contest as well as a more genuine reflection of the game's true level of achievement, accomplishment, and competition. Whereas other scoring systems may focus on individual statistics that may be irrelevant to results by itself, the teachings of the present disclosure provides a quantitative measurement of the plays and achievements during any given game that actually impact the game's outcome.

FIG. 1 depicts a generalized flow chart of the setup and application of the method according to the disclosed subject matter. At step 100 the possible plays in a particular contest are identified. Then some subset of the possible plays are identified as the big plays (those plays that change the moment of the game or are otherwise non-routine) 102. Each of the identified big plays are assigned a relative big play point value 104. The big play point value is an indication of just how "big" the play is when compared to the normal and routine plays in a contest. Finally, each big play is categorized, for example, into offense, defense, or both 106. Because a particular play could result in multiple big plays (e.g. first-down to first-down and a touchdown of 50+ yards) only the highest scoring big play is kept. By categorizing the big plays, it makes identifying which of the big plays scores the highest while still allowing each team to receive points for a big play. This completes the basic setup 107.

Statistics are received from a statistics provider which represent one or more plays in a contest 108. The statistics could be streamed live or after the end of the contest. The statistics are analyzed to identify one or more big plays 110. If there were any big plays, the big plays are scored according to the associated big play point value 112. For each play and for each category and/or participant (e.g. team) in the contest, only the largest big play point value is kept 114. For each of the categories and/or participants, all of the kept big play point values are totaled 116. If the contest is not over 118, more statistics are received 108 and the process continues. If the contest is over 118, the totals are output and/or compared to identify a winner 120.

As a more concrete example, scoring rules and point values for a fantasy league football are discussed in more detail. The scoring system is affected by designating, to the offense, defense, and special teams, awards of pre-determined points for corresponding big plays. Again, these are plays and actions that are relatively exceptional when compared to regular touchdowns or five yard passes. For exemplary purposes, a gain of 10 yards on First Down would garner a point because it results in going "First Down to First Down". But on any other down, there must be a score, or a gain of at least 20 yards to get points. A gain of 19 yards on 2nd or 3rd down would not be awarded points, and it would only earn points on 4th Down if it resulted in a "4th Down Conversion".

The system does not allow for awards of multiple plays to any given team for any given one play; it will choose the big play that grants the most points. For exemplary purposes, a gain of 40+ yards on First Down would not get 1 Point for going "First Down to First Down" and 2 Points for a "Gain of 40+ yards". The play would be awarded just the two points for the offense having gained 40+ yards. However, sometimes both teams can score big play points on the same play. If an offensive unit in the Red Zone (within 20 yards of the goal line) is held to a Field Goal, they would get 1 Point for having scored, but the defensive unit would also be awarded 1 Point for having held their opponent in the Red Zone to only a Field Goal.

Points earned are points kept; the system does not penalize points for forced or unforced errors. One should understand, for example, that a failed Onside Kick attempt that is recovered beyond the 50-yard line (as, of course, it is likely by definition of a failed Onside Kick attempt) would count as 1 big play point for the opposing team because it's the Special Teams returning (recovering) a Punt/Kickoff beyond the 50-yard line.

In practice, a fantasy sport participant would be able to organize a hybrid team challenge, a big play point originated, multi-person engagement game pitting participants' knowledge of teams against one another whereby one seeks the greatest sum total of one of 32 team's offense, one of 32 team's defense, and one of 32 team's special teams. As noted previously, this enables participation by those who have a basic understanding of sport dynamics and basic team formations, but lack the knowledge of diehard sports fanatics and enthusiasts. All that is required to compete is the ability to pick and choose one of the National Football League's 32 teams and their offensive, defensive, or special teams. An alternative exemplary embodiment of the present disclosure would be a quick-pick version of the hybrid team challenge wherein a computer system auto-generates a random selection of the three components for participation in the hybrid team challenge.

It is contemplated within the present disclosure to enable wagering via Sunday and Monday Night Football Mulligan Exactas. This is a self-perpetuating Component of the hybrid team challenge that encourages and otherwise fosters a continued engagement in the game by including additional scoring opportunity by virtue of the outcome of the final game of the weekend, and ability to predict superiority of the two teams' three units relative to each other.

It is further contemplated that the scoring system may include a scoring trifecta, the achievement of accurately predicting each of the weekend's top big play selections for offense, defense, and special teams. In this way, the system further fosters participation and engagement by providing incentives for high level performance, while not necessarily having to compete against any other fantasy sport league participant.

Furthermore, the disclosed subject matter could be integrated into, or made the focus or background or, Broadcast Studio Production and/or Pre- and Post-Game Analysis including past and future games.

Additionally, the teachings of the present disclosure may be enabled within broadcast content generation, sports commentary, analysis, reporting, and various social media related applications. When it comes to sports, invariably, invincibility gives way to the inevitability of diminishing strength, skills, and reflexes. With sports commentary, analysis and reporting, the magic of an original style is as infinite as the desire to improve with each and every opportunity.

Again, it is important to note that although this disclosure focuses on football, almost any other sport where at least one player actively plays against at least one other player is considered within the disclosure and the disclosed subject matter could be relatively easily adapted to fit the other sport. For example, these other sports could include, but are not limited to: basketball, baseball, tennis, cricket, soccer, hockey, korfball, netball, slamball, rugby, cuju, harpastum, kemari, volata, hurling, handball, kickball, lapta, oina, softball, lacrosse, field hockey, bandy, broomball, polo, volleyball, fistball, and each of the foregoing's variants, predecessors, and progeny.

As an additional example, sample criteria for baseball are provided:

Hitting

| Points | Description |
|---|---|
| 1 | Double w/ No Outs |
| 1 | Triple w/ less than 2 outs |
| 1 | Run Scored |
| 1 | Hit/Walk to load bases with less than 2 outs |
| 2 | 2 runs |
| 2 | Stealing Home |
| 2 | Homerun |
| 3 | 2 RBI Homerun |
| 3 | 3 runs |
| 4 | 3 RBI Homerun |
| 5 | Grand Slam |

Fielding

| Points - | Description |
|---|---|
| 1 | Double Play |
| 1 | Runner thrown out stealing, leading off, tagging up |
| 1, 2, 3 | Caught stealing at 2nd, 3rd, or Home |
| 2 | Runner at the corners Inning-Ending Out |
| 2 | Bases Loaded Inning-Ending Out |
| 2 | Inning-Ending Double Play |
| 3 | Bases Loaded Inning-Ending Double Play |
| 4 | Triple Play |

Pitching

| Points | Description |
|---|---|
| 1 | RISP Strikeout |
| 1 | Consecutive Batter Strikeout |
| 1 | Runner stranded at 3rd with less than 2 outs |
| 2 | Bases Loaded Inning-Ending Strikeout |
| 3 | Strikeout the side |

As an additional example, sample criteria for basketball are provided:

Offense

| Points | Description of Play |
|---|---|
| 2 | Rebound |
| 2 | Field Goal/Free Throw to go up ten points or more |
| 2 | Field Goal/Free Throw to cut lead to single digits |
| 2 | Converted "And 1" |
| 2 | Second-chance point(s) |

-continued

| Points | Description of Play |
|---|---|
| 2 | 3-pt shot |
| 3 | Successive Possession 3-point shots |
| 3 | Fast Break |
| 3 | Offensive Rebound and "Put-Back" |

Defense

| Points | Description of Play |
|---|---|
| 2 | Rebound |
| 2 | Block |
| 3 | Drawn Charge |
| 3 | Steal |
| 3 | Forced Turnover |
| 3 | Possession-ending Block |
| 3 | Defended Fast Break |

As an additional example, sample criteria for football are provided:

Offense

| Points | Play Description |
|---|---|
| 1 | First Down to First Down |
| 1 | Gain of 20+ yards |
| 1 | Field Goal |
| 1 | 4th Down Conversion |
| 2 | Gain of 40+ yards |
| 2 | Touchdown |
| 2 | 2-Point Conversion |
| 3 | Touchdown of 50+ yards |

Defense

| Points | Play Description |
|---|---|
| 1 | Sack/Intentional Grounding |
| 1 | 3 and out |
| 1 | Fumble Recovery |
| 1 | Interception |
| 1 | Hold Opponent to Red Zone Field Goal |
| 1 | Defended 2-pt conversion attempt |
| 2 | Forced Turnover on Downs |
| 2 | Fumble Recovery in/returned to Red Zone |
| 2 | Interception in/returned to Red Zone |
| 2 | Hold Opponent to Red Zone No Score |
| 2 | Safety |
| 3 | Defensive Touchdown |
| 3 | Turnover in "one score" situation to "ice" game, as defined by preceding victory formation. |

Special Teams

| Points | Play Description |
|---|---|
| 1 | Blocked/Missed Extra Point Attempt |
| 1 | Coffin Corner Punt/Kick |
| 1 | Fumble Recovery |
| 2 | Fumble Recovery in/returned to Red Zone |
| 1 | Punt/Kickoff Return Team returns ball beyond the 50-yard line |
| 2 | Punt/Kickoff Return Team returns ball to Red Zone |
| 2 | Blocked Punt/Field Goal Attempt |
| 2 | Onside Kickoff |
| 3 | SpecialTeams Touchdown |

As an additional example, sample criteria for golf are provided:

| Points | Play Description |
|---|---|
| 1 | 3rd in a row, and each consecutive thereafter, Fairway Hit |
| 1 | 3rd in a row, and each consecutive thereafter, Greens in Regulation |
| 2 | On in One on a Par 4 |
| 2 | On in Two on a Par 5 |
| 2 | Up and Down |
| 2 | Sand Save |
| 3 | Chipping In |
| 3 | Wedging In |
| 1 | Birdie, +1 for 1 for each of the total number of additional consecutive birdies or better |
| 3 | Eagle |
| 5 | Hole in One |
| 1-Putt | |
| 1 | Putt > 10' |
| 2 | Putt > 20' |

As an additional example, sample criteria for ice hockey are provided:

5 point for goal for first three of a 3-goal advantage, then a 1 for 1 diminishment Offense

| Face Off Win = Puck Possession |
|---|
| Center Ice/Start of Period |
| Period 1 - 1 point |
| Period 2 - 1 point |
| Period 3 |
| Up by 1 or more - 1 point |
| Down by 1 or more - 2 points |
| Down by 3 or more - 3 points |
| Offensive Zone |
| Period 1, 2 and 3 |
| Up by 1 or more - 1 point |
| Defensive Zone |
| Period 1, 2, and 3 |
| Down by 1 or more |
| 2 points in 2nd, 3 points in 3rd period with <5 minutes |
| Pass Plays |
| Offensive Zone |
| successful transfer of puck out of zone |
| points contingent upon time and score |
| up by 1-3: 1 point |
| down by 1-3: 2 points in Period 2 |
| down by 1-3: 3 points in Period 3 |
| Power Play (PP) |
| Period 1 |
| 5 on 4 - 2 points |
| Period 2 |
| 5 on 4 - 2 points if tied, 3 points if down by 1 or more |
| 5 on 3 - 3 points |
| Period 3 |
| 5 on 4 - 3 points, if 2 goal discrepancy or less |
| 5 on 3 - 4 points, if 2 goal discrepancy or less |
| Penalty Kill (PK) |
| Periods 1 & 2 - 1 point |
| Period 3 |
| 1 point discrepancy - 2 points |
| 2 point discrepancy - 1 point |

As an additional example, additional sample criteria for ice hockey are provided:

Goals—Offense

Goal—1 point

First Goal—2 points

Short Handed Goal—3 points

Overtime Goal—3 points

Goal in the Last 90 Seconds of Period—3 points

Power Play Goal—2 points

Back to Back Goals—2 points

Misc.

Penalty Kill—1 point (Defense)

Off Sides/Pass Control—1 point (Offense/Defense)

Won Offensive Zone Faceoff—1 point (Offense)

Clearing Puck from Defensive Zone—1 point (Defense)

Penalties

Minor Penalty—1 point (Offense/Defense)

Major Penalty—2 points (Offense/Defense)

As an additional example, sample criteria for rugby are provided:

Offense

| | |
|---|---|
| 1 | Fast Break on Wings |
| 2 | Scrum Win |
| 2 | Penalty |
| 1 | Unlevel Teams (from injuries or penalties . . . point per minute) |
| 3 | Kick on Goal |
| 3 | Extra Point |
| 4 | Successful Kick for Possession |
| 5 | "Try", (the equivalent of a touchdown) |

Defense

| | |
|---|---|
| 1 | Turnover out of a ruck or a maul |
| 1 | Kick for position |
| 2 | Defense earns a line-out |
| 2 | Penalty |
| 1 | Unlevel Teams (from injuries or penalties . . . point per minute) |
| 4 | Line-out Final 1/3 |

As an additional example, sample criteria for soccer are provided:

Offense

| | |
|---|---|
| 1 | Seven consecutive touches "on own half" |
| 1 | Yellow Card |
| 1 | Corner Kick |
| 2 | Free Kick |
| 3 | Free Kick on "Final 1/3" |
| 4 | Penalty Kick |
| 5 | Red Card |
| 6 | Goal |

Defense

| | |
|---|---|
| 1 | Punched Out/Caught Corner Kick |
| 2 | Saved Shot on Goal |
| 2 | Off-sides Trap |
| 4 | Off-sides Trap on "Final 1/3" |
| 5 | Saved Penalty Kick |

As an additional example, sample criteria for tennis are provided:

| Points | Description |
|---|---|
| 1 | Winner |
| 2 | Ace |
| 2 | Service Return Winner |
| 3 | Love Game |
| 4 | Service Break |
| 5 | Win Set |

The foregoing description of the preferred embodiments is provided to enable a person skilled in the art to make or use the claimed subject matter. Various modifications to these embodiments, including changing point values and/or adding or deleting point opportunities, will be readily apparent to those skilled in the art, and the generic principles defined herein may be applied to other embodiments without the use of the innovative faculty. Thus, the claimed subject matter is not intended to be limited to the embodiments shown herein but is to be accorded the widest scope consistent with the principles and novel features disclosed herein.

The detailed description set forth herein in connection with the appended drawings is intended as a description of exemplary embodiments in which the presently disclosed apparatus and system can be practiced. The term "exemplary" used throughout this description means "serving as an example, instance, or illustration," and should not necessarily be construed as preferred or advantageous over other embodiments.

Further, although exemplary devices and figures to implement the elements of the disclosed subject matter have been provided, one skilled in the art, using this disclosure, could develop additional hardware and/or software to practice the disclosed subject matter and each is intended to be included herein.

In addition to the above described embodiments, those skilled in the art will appreciate that this disclosure has application in a variety of arts and situations and this disclosure is intended to include the same.

What is claimed is:

1. An apparatus operable to quantify one or more relevant and active physical efforts performed by two or more different competing real-life football teams, the two or more different competing real-life football teams engaging in at least one real-life American-style football contest or its adaptations with a predefined traditional point value for certain plays and resulting in a traditionally defined winner and loser, the apparatus further operable to:

receive statistics via a communications medium in real-time, said statistics directly representing one or more plays from said at least one real-life American-style football contest or its adaptations relative to an offense, defense, or special teams unit, wherein said offense, defense, or special teams unit comprises eleven football players;

analyze said statistics in real-time on a processor to identify all big plays in said statistics, wherein said big plays are defined as a team achievement performed by said offense, defense, or special teams unit;

classify a subset of all possible plays in said at least one real-life American-style football contest or its adaptations as said big plays;

assign a big play point value to each of said big plays, said big play point value relative to the impact said big play has on said at least one real-life American-style football contest or its adaptations, wherein at least one of said big play point values is different than said predefined traditional point value, and wherein at least one of said big plays is one of said all possible plays without said predefined traditional point value;

categorize said big plays, said categories comprising offensive big plays, defensive big plays, and special teams big plays, said offensive big plays being those big plays which are offensive with respect to said at least one real-life American-style football contest or its adaptations, wherein said offensive big plays are selected from the group consisting of:

first-down to first-down, gain of 20+ yards, field goal, fourth down conversion, gain of 40+ yards, touch down, two point conversion, and touchdown of 50+ yards;

said defensive big plays being those big plays which are defensive with respect to said at least one real-life American-style football contest or its adaptations, wherein said defensive big plays are selected from the group consisting of:

sack, intentional grounding, "three and out", fumble recovery, interception, opponent held to red zone field goal, two point conversion attempt defended, turnover forced on downs, fumble recovery in red zone, fumble recovery returned to red zone, interception in red zone, interception returned to red zone, opponent held to no score in red zone, safety, defensive touchdown, and turnover in "one score" situation to "ice" said at least one real-life American-style football contest or its adaptations; and said special teams big plays being those big plays which are special teams related with respect to said at least one real-life American-style football contest or its adaptations, wherein said special teams big plays are selected from the group consisting of:

blocked/missed extra point attempt, coffin corner punt, coffin corner kick, fumble recovery, fumble recovery in the redzone, fumble recovery returned to the red zone, ball returned beyond the 50 yard line by punt return team, ball returned beyond the 50 yard line by kickoff return team, ball returned to red zone by punt return team, ball returned to red zone by kickoff return team, blocked punt attempt, blocked field goal attempt, onside kickoff, and special teams touchdown;

transform each of said identified big plays to said big play point values;

identify said big play point value for each of said big plays for each of said categories;

tabulate all of said identified big play point values for each of said categories; and transform computer memory to represent a total of each category.

2. The apparatus of claim 1, wherein the apparatus is further operable to repeat the receiving, analyzing, classifying, assigning, categorizing, transforming, identifying, and tabulating for the one or more plays in said at least one real-life American-style football contest or its adaptations.

3. The apparatus of claim 1, wherein said big play point values are based on team element achievements.

4. The apparatus of claim 1, wherein all of said big play point values are accumulated to determine the true level of achievement and competition in said at least one real-life American-style football contest or its adaptations.

5. The apparatus of claim 1, said apparatus used in conjunction with a fantasy sports league, by selecting a "hybrid team" comprised of at least an offensive team element, a defensive team element, and a special teams team element from said two or more different competing real-life football teams engaged in said at least one real-life American-style football contest or its adaptations.

6. The apparatus of claim 1, said apparatus used in conjunction with a sports broadcast.

7. The apparatus of claim 1, said apparatus used in conjunction with sports gambling.

8. A non-transitory computer readable medium encoded with instructions for quantifying one or more relevant and active physical efforts performed by two or more different competing real-life football teams, the two or more different competing real-life football teams engaging in at least one real-life American-style football contest or its adaptations with a predefined traditional point value for certain plays and resulting in a traditionally defined winner and loser, the instructions executable on a processor to:

receive statistics via a communications medium in real-time, said statistics directly representing one or more plays from said at least one real-life American-style football contest or its adaptations relative to an offense, defense, or special teams unit, wherein said offense, defense, or special teams unit comprises eleven football players;

analyze said statistics in real-time on a processor to identify all big plays in said statistics, wherein said big plays are defined as a team achievement performed by said offense, defense, or special teams unit;

classify a subset of all possible plays in said at least one real-life American-style football contest or its adaptations as said big plays;

assign a big play point value to each of said big plays, said big play point value relative to the impact said big play has on said at least one real-life American-style football contest or its adaptations, wherein at least one of said big play point values is different than said predefined traditional point value, and wherein at least one of said big plays is one of said all possible plays without said predefined traditional point value;

categorize said big plays, said categories comprising offensive big plays, defensive big plays, and special teams big plays, said offensive big plays being those big plays which are offensive with respect to said at least one real-life American-style football contest or its adaptations, wherein said offensive big plays are selected from the group consisting of:

first-down to first-down, gain of 20+ yards, field goal, fourth down conversion, gain of 40+ yards, touchdown, two point conversion, and touchdown of 50+ yards;

said defensive big plays being those big plays which are defensive with respect to said at least one real-life American-style football contest or its adaptations, wherein said defensive big plays are selected from the group consisting of:

sack, intentional grounding, "three and out", fumble recovery, interception, opponent held to red zone field goal, two point conversion attempt defended, turnover forced on downs, fumble recovery in red zone, fumble recovery returned to red zone, interception in red zone, interception returned to red zone, opponent held to no score in red zone, safety, defensive touchdown, and turnover in "one score" situation to "ice" said at least one real-life American-style football game or its adaptations; and said special teams big plays being those big plays which are special teams related with respect to said at least one real-life American-style football contest or its adaptations, wherein said special teams big plays are selected from the group consisting of:

blocked/missed extra point attempt, coffin corner punt, coffin corner kick, fumble recovery, fumble recovery in the redzone, fumble recovery returned to the red zone, ball returned beyond the 50 yard line by punt return team, ball returned beyond the 50 yard line by kickoff return team, ball returned to red zone by punt return team, ball returned to red zone by kickoff return team, blocked punt attempt, blocked field goal attempt, onside kickoff, and special teams touchdown;

transform each of said identified big plays to said big play point values;

identify said big play point value for each of said big plays for each of said categories;

tabulate all of said identified big play point values for each of said categories; and transform computer memory to represent a total of each category.

9. The medium of claim 8, wherein said big play point values are based on team element achievements.

10. The medium of claim 8, wherein all of said big play point values are accumulated to determine the true level of achievement and competition in said at least one real-life American-style football contest or its adaptations.

11. The medium of claim 8, said medium used in conjunction with a fantasy sports league, by selecting a "hybrid team" comprised of at least an offensive team element, a defensive team element, and a special teams team element from said at least two different competing real-life football teams engaged in said at least one real-life American-style football contests or its adaptations.

12. The medium of claim 8, said medium used in conjunction with a sports broadcast.

13. The medium of claim 8, said medium used in conjunction with sports gambling.

14. A computer implemented method for quantifying one or more relevant and active physical efforts performed by two or more different competing real-life football teams, the two or more different competing real-life football teams engaging in at least one real-life American-style football contest or its adaptations with a predefined traditional point value for certain plays and resulting in a traditionally defined winner and loser, the method comprising the following steps:

receiving statistics via a communications medium in real-time, said statistics directly representing one or more plays from said at least one real-life American-style football contest or its adaptations relative to an offense, defense, or special teams unit, wherein said offense, defense, or special teams unit comprises eleven football players;

analyzing said statistics in real-time on a processor to identify all big plays in said statistics, wherein said big plays are defined as a team achievement performed by said offense, defense, or special teams unit;

classifying a subset of all possible plays in said at least one real-life American-style football contest or its adaptations as said big plays;

assigning a big play point value to each of said big plays, said big play point value relative to the impact said big play has on said at least one real-life American-style football contest or its adaptations, wherein at least one of said big play point values is different than said predefined traditional point value, and wherein at least one of said big plays is one of said all possible plays without a predefined traditional point value;

categorizing said big plays, said categories comprising offensive big plays, defensive big plays, and special teams big plays, said offensive big plays being those big plays which are offensive with respect to said at least one real-life American-style football contest or its adaptations, wherein said offensive big plays are selected from the group consisting of:

first-down to first-down, gain of 20+ yards, field goal, fourth down conversion, gain of 40+ yards, touchdown, two point conversion, and touchdown of 50+ yards;

said defensive big plays being those big plays which are defensive with respect to said at least one real-life American-style football contest or its adaptations, wherein said defensive big plays are selected from the group consisting of:

sack, intentional grounding, "three and out", fumble recovery, interception, opponent held to red zone field goal, two point conversion attempt defended, turnover forced on downs, fumble recovery in red zone, fumble recovery returned to red zone, interception in red zone, interception returned to red zone, opponent held to no score in red zone, safety, defensive touchdown, and turnover in "one score" situation to "ice" said at least one real-life American-style football game or its adaptations; and said special teams big plays being those big plays which are special teams related with respect to said at least one real-life American-style football contest or its adaptations, wherein said special teams big plays are selected from the group consisting of:

blocked/missed extra point attempt, coffin corner punt, coffin corner kick, fumble recovery, fumble recovery in the redzone, fumble recovery returned to the red zone, ball returned beyond the 50 yard line by punt return team, ball returned beyond the 50 yard line by kickoff return team, ball returned to red zone by punt return team, ball returned to red zone by kickoff return team, blocked punt attempt, blocked field goal attempt, onside kickoff, and special teams touchdown;

identifying said big play point value for each of said big plays for each of said categories;

tabulating all of said identified big play point values for each of said categories; and transform computer memory to represent a total of each category.

15. The method of claim 14, wherein said big play point values are based on team element achievements.

16. The method of claim 14, wherein all of said big play point values are accumulated to determine the true level of achievement and competition in said at least one real-life American-style football contest or its adaptations.

17. The method of claim 14, said method used in conjunction with a fantasy sports league, by selecting a "hybrid team" comprised of at least an offensive team element, a defensive team element, and a special teams team element from said two or more different competing real-life football teams engaged in said at least one real-life American-style football contest or its adaptations.

18. The method of claim 14, said method used in conjunction with a sports broadcast.

19. The method of claim 14, said method used in conjunction with sports gambling.

* * * * *